US006604513B1

(12) United States Patent
Lo

(10) Patent No.: US 6,604,513 B1
(45) Date of Patent: Aug. 12, 2003

(54) POWER ENHANCEMENT CONTROL SYSTEM FOR COMBUSTION ENGINE

(76) Inventor: Jui-Yang Lo, No. 2, Alley 27, Lane 143, Yuanshan Rd., Junghe City, Taipei Hsien (TW)

( * ) Notice: Subject to any disclaimer, the term of this patent is extended or adjusted under 35 U.S.C. 154(b) by 0 days.

(21) Appl. No.: 10/057,975

(22) Filed: Jan. 29, 2002

(51) Int. Cl.[7] ..... F02M 27/00
(52) U.S. Cl. ..... 123/537; 123/539
(58) Field of Search ..... 123/536, 537, 123/538, 539

*Primary Examiner*—Noah P. Kamen

(74) *Attorney, Agent, or Firm*—Rosenberg, Klein & Lee

(57) ABSTRACT

An oil-saving accelerating control device of eliminating the black smoke mainly comprising a power-increasing means and a pressure increasing auxiliary device in cooperative the inlet branch of the gas-combustion engine, by means of the high-voltage output produced by the power increasing means, after the air within the metal inside is being purified, it produces more oxygen to increase the efficiency of the gas-combustion engine and thus it saves the fuel as well as increasing the power; besides, by cooperative with the pressure-increasing device, when the power-increasing means is acting, it collects more oxygen on the same time on acting the power-increasing means, whereas the operator could provide more oxygen to the effect of gas-combustion engine for usage through controlling a initiation switch.

6 Claims, 5 Drawing Sheets

POWER ENHANCEMENT CONTROL SYSTEM FOR COMBUSTION ENGINE

BACKGROUND OF THE INVENTION

1. Field of the Invention

This invention relates to a fuel-saving power enhancement control system for a combustion engine which effects clean combustion. More specifically, the system relates to technology in which excess oxygen is stored in a high-pressure gas-storage bottle by action of an air flowing pump for subsequent introduction into a combustion cylinder in suitably controlled manner.

2. Description of the Prior Art

Conventional technology for increasing the power of a combustion engine includes SUPER CHARGE and TURBO CHARGE techniques, and these two techniques involve adding functions to the original engine design. A car without such additions to its engine is within the increase in power otherwise achieved. Also, there is no benefit provided by the techniques toward improving the engine's natural environmental impact.

Another conventional technique for increasing the power of a combustion engine is to provide more clean air in the cylinder wherein the oxygen-containing amounts are higher in the cold air than in the hot air. As shown in FIG. 1, the intake air from outside the car enters through a branch tube 3 and into a cylinder 5 for combustible explosion therein via an auxiliary device 6 setting the air cleaner 62 and the air pump 61. However, such device does not effectively control the black exhaust smoke produced by the gas combustion engine.

There is a need, therefore, to address such drawbacks of the above-mentioned techniques for increasing the power of a gas combustion engine.

SUMMARY OF THE INVENTION

The main purpose of this invention is to provide for a combustion engine an efficient power enhancement control which augments clean combustion wherein, by means of the set-up of a pressure-increasing auxiliary device, excess oxygen is passed for storage into a high-pressure gas-storage bottle, pumped by a single-direction air flowing pump during operation, so that oxygen from the high-pressure storage bottle may be provided for use in a subsequent combustion to provide power enhancement.

Another purpose of this invention is to provide a suitable way by which to increase the power of various kinds of gas combustion engines. In one embodiment, the system includes a power increasing device that promotes clean combustion utilizing a high-voltage electrolyte air, then guiding it into a combustion chamber (cylinder) of the gas combustion engine to increase the combustion efficiency of the fuel, so as to elevate the power of the gas combustion engine. Use of such power-increasing device makes the engine start more easily and effects a power increase of up to 20%, which saves the consumption of fuel, decreases black exhaust smoke, and minimizes the production of carbon deposits. This extends the life of the engine and catalytic converter.

In order to let the engine operate optimally, the power-increasing device starts up upon the engine starting-up, and any excess in produced oxygen is passed to fill a gas storage bottle with high-pressure compression. When it is subsequently necessary for the engine to produce more power, the oxygen inside the gas storage bottle is introduced directly into the engine combustion chamber (cylinder) upon appropriate control of a switch.

Another purpose of this invention is to provide a fuel-saving power enhancement control system in which suitable supplying of the stored oxygen to the gas combustion engine may be conveniently effected by initiating a switch control gate valve based upon a reading of a pressure gauge provided on a display panel. An operator may visually seize the status of the fuel and the engine's performance to manually actuate the power enhancement.

Another purpose of this invention is to provide a fuel-saving power enhancement control system wherein an output terminal of the high-pressure loop device is coupled to the combustion engine's inlet branch. If the inlet branch is not made of electrically conductive material, a metal conducting sheet with grounding is disposed along an inner tube wall of the inlet branch so as to operate with the output terminal of the high voltage loop device in producing more oxygen.

The fuel-saving power enhancement control system for achieving the above-mentioned purposes of this invention comprises a power-increasing means having a high-voltage loop device; a power input initiator connected to an input terminal of the high-voltage loop device; and, an output terminal leading from the high-voltage loop device for applying a high voltage responsive to initiation of the power input initiator.

The system also comprises a pressure increasing auxiliary device having a directional control valve; a single-directional air flowing pump connected by a pipeline to the directional control valve; and, a high-pressure gas storage bottle connected by a pipeline to the single-directional air flowing pump.

An outlet pipe is formed on the high-pressure gas storage bottle; and, at a suitable position of the outlet pipeline is disposed a flow rate control valve. Connected to the flow rate control valve is an initiating switch which is set at a position easily accessible to the driver. Upon actuation of the initiating switch, the closed state of the flow control valve is changed.

A pressure gauge is coupled to a suitable point of the pipeline between the single-directional air flowing pump and the high-pressure gas storage bottle. The pressure gauge displays for the user the pressure at the control terminal of the directional control valve and the output of the single-directional air flowing pump when they have been initiated.

The output terminal of the high-voltage loop is set inside the inlet branch of the cylinder of the combustion gas engine such that more oxygen gas may be produced inside between the output terminal of the high-voltage loop device and the inner tube wall of metal of the inlet branch. In an alternate embodiment where the inlet branch is formed of a non-conductive material, a grounding metal conducting sheet is disposed at an inner tube wall of the inlet branch, and the directional control valve of the pressure-increasing auxiliary device is connected to the inlet branch by a pipeline at a point disposed between the output terminal of the high-voltage loop device and the point at which the outlet pipeline of the gate valve is connected to the cylinder.

BRIEF DESCRIPTION OF THE DRAWINGS

The drawings disclose illustrative embodiments of the present invention which serve to exemplify the various advantages and objectives hereof, and are as follows.

DETAILED DESCRIPTION OF THE PREFERRED EMBODIMENTS

Figure 1:
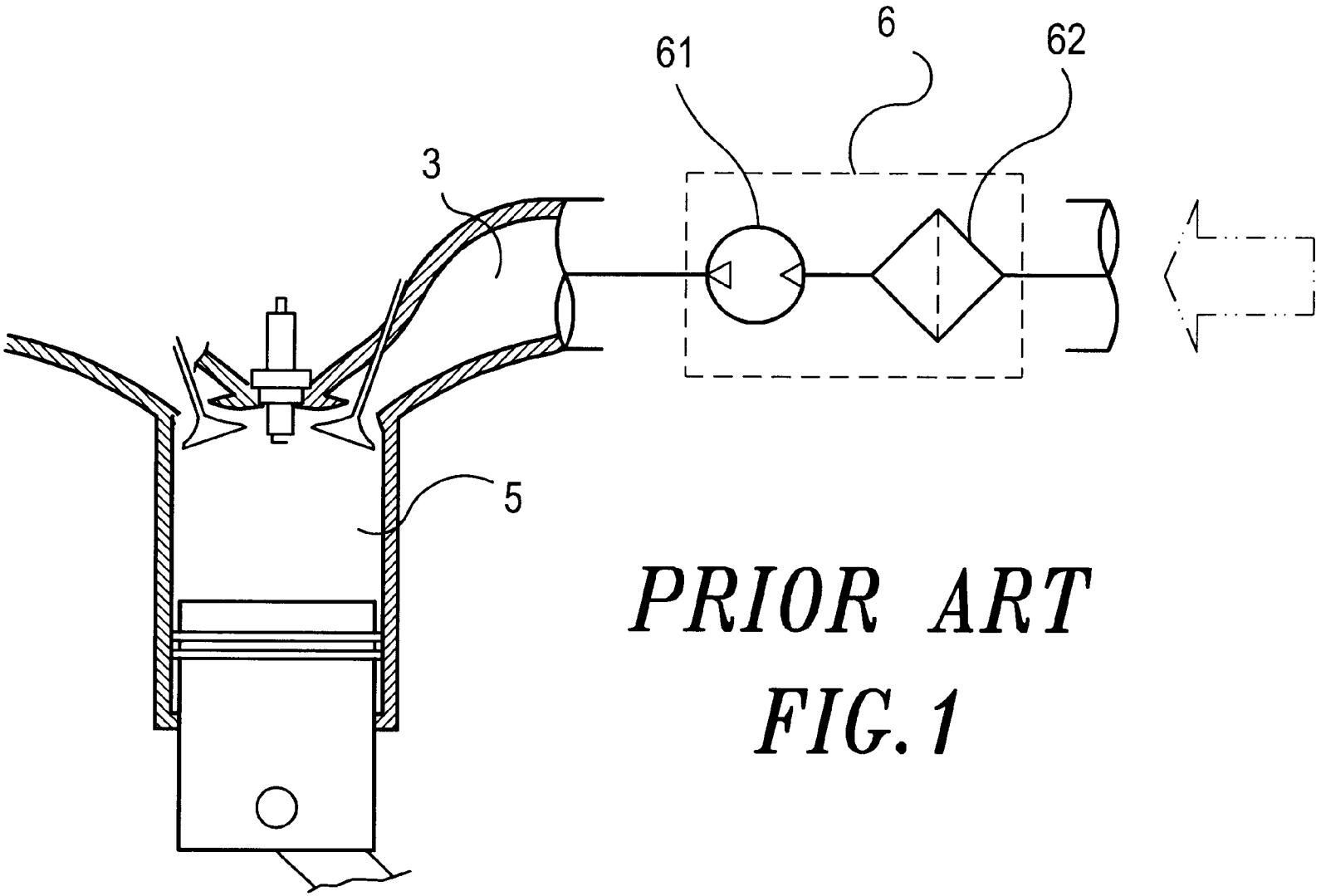
PRIOR ART FIG. 1
FIG. 1 is a schematic diagram illustrating the operation of conventional power-increasing means.
Figure 2A:
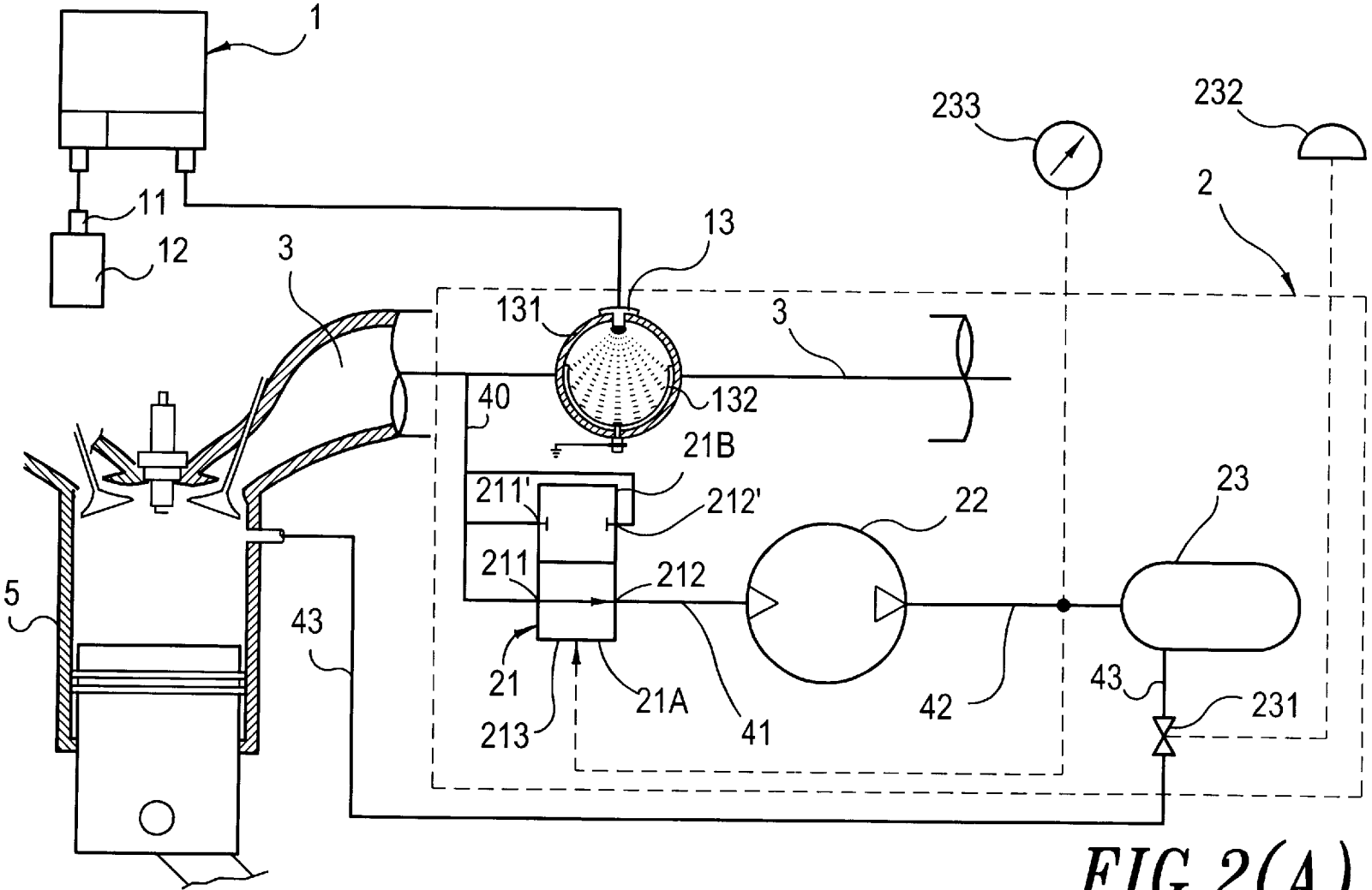
FIGS. 2(A) and (B) are schematic diagrams illustrating a preferred embodiment of the power enhancement control system of the present invention.
Figure 2B:
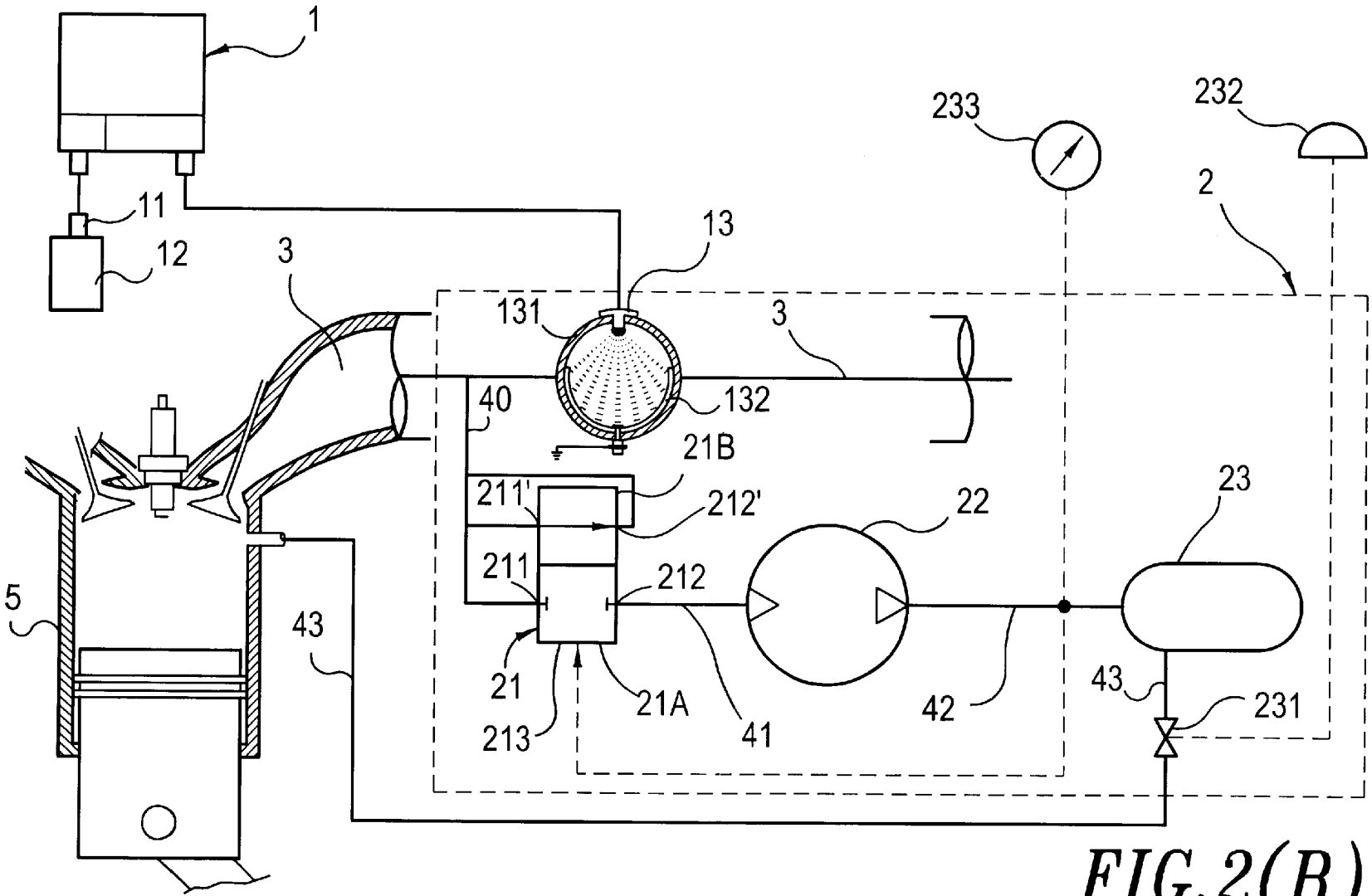

FIGS. 2(A) and 2(B) schematically illustrate a preferred embodiment of the power enhancement control system for a combustion engine of this invention. FIG. 2(A) illustrates an operational state before initiating a pressure-increasing auxiliary device; while FIG. 2(B) illustrates an operational state after initiating the pressure-increasing auxiliary device. The inventive system comprises generally a power increasing means 1 and a pressure-increasing auxiliary means 2 communicating with the inlet branch 3 of the gas combustion engine. The power-increasing means 1 is a high-voltage loop device, at the input terminal of which is connected a power input initiator 12. Upon the start-up of this power input initiator 12, the output terminal 13 of the high-voltage loop is set to a high voltage.

The pressure-increasing auxiliary means 2 comprises generally a directional control valve 21, single-directional air flowing pump 22, and a high-pressure gas-storage bottle 23. The directional control valve 21 is set to be of a 2/2 type. That is, there are two inlets/outlets on the valve body (as shown by the inlets 211, 211', and outlets 212, 212' in the Figure), and there are two specific states 21A and 21B. The single-directional air flowing pump 22 is connected to the directional control valve 21 by a pipeline 41. The high-pressure gas-storage bottle 23 is connected by a pipeline 42 to the single air flowing pump 22. Leading from the high-pressure gas storage bottle 23 is an outlet pipeline 43 in which is disposed a flow rate control valve, preferably realized in the form of a gate valve 231. The gate valve 231 is connected to an initiating switch 232 by which the closed state of the gate valve 231 may be changed. At a suitable point along the pipeline 42 between the single-directional air flowing pump 22 and the high-pressure gas-storage bottle 23 there is connected a pressure gauge 233. The state of the initiation of a control terminal 213 of the directional control valve 21 and the single-directional air flowing pump 22 may be changed according to a setting point of the pressure, with the pressure status display of the pressure gauge 233 being installed on a panel for inspection by an operator.

When the high-voltage loop output terminal 13 of the power-increasing means 1 is installed inside an inlet branch 3 of a cylinder 5 in a gas combustion engine, and when the power input initiator 12 opens, the output terminal 13 of the high-voltage loop causes a metal conducting sheet 132 of the inlet branch 3 to produce more oxygen. The directional control valve 21 of the pressure-increasing auxiliary means 2 is connected with the inlet branch 3 by a pipeline 40, with the connection site being between the high-voltage loop output terminal 13 of the power-increasing means 1 and the cylinder 5. The outlet pipeline 43 leads from the gate valve 231 to connect to the cylinder 5, such that when the pressure sensed by the pressure gauge does not reach the setting level (i.e., the high-voltage gas storage bottle does not reach a threshold pressure), the directional control valve 21 is set to position 21A. This opens the inlet 211 and the outlet 212, whereby the single-directional air flowing pump 22 assumes an "always open" state as shown in FIG. 2(A).

As excess oxygen is produced via the metal conducting sheet 132 of the inlet branch 3 and the output terminal 13 of the high-voltage loop, the oxygen is transported by pipeline 40 through the action of the single-directional air flowing pump 22. When the pressure sensed by the pressure gauge 233 reaches the required level (i.e., the high-voltage gas-storage bottle 23 reaches the threshold pressure), the directional control valve 21 is set to position 21 B. This opens the inlet 211' and the outlet 212', whereby the single-directional air flowing pump 22 assumes an "always closed" state as shown in FIG. 2(B). The pressure-increasing auxiliary device 2 then stops operation.

If the inner pressure inside the high-pressure gas storage bottle 23 is higher than the pressure inside the cylinder 5 during a scheduled air intake of the cylinder 5, the operator may actuate an initiating switch 232 to switch the gate valve accordingly. When the operator switches the gate valve 231 to the 'open' state by means of the initiating switch 232, the oxygen stored inside the high-pressure gas storage bottle 23 enters the cylinder 5 through the outlet pipeline 43 to supply the cylinder 5 for scheduled combustion. Otherwise, when the user switches the gate valve 231 to its 'closed' state by actuating the initiating switch 232, flow is cut off, and the oxygen stored inside the high-pressure gas storage bottle 23 remains stored therein.

Figure 3:
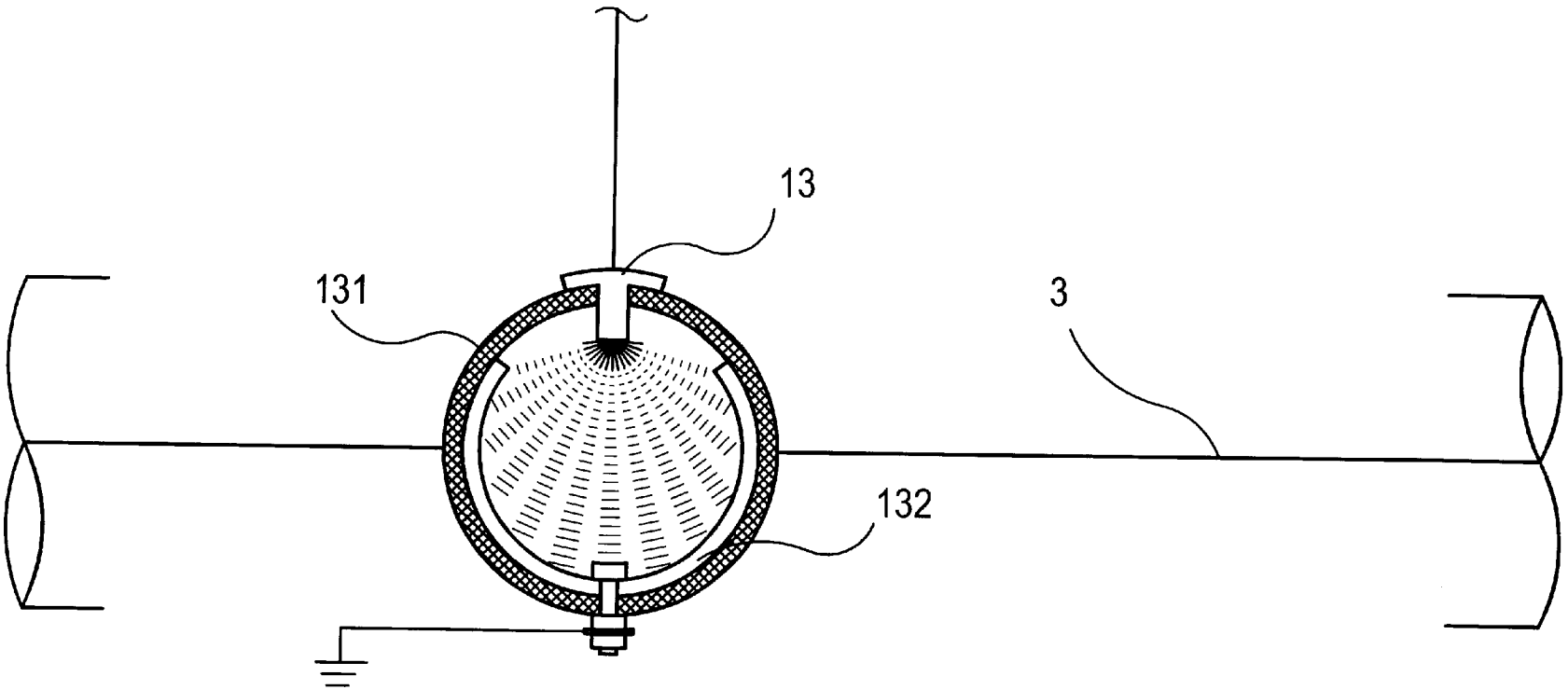
FIG. 3 is a schematic diagram illustrating a portion of the power enhancement control system of the present invention in a second embodiment; and, FIGS. 4(A) and (B) are schematic diagrams illustrating a portion of the power enhancement control system of the present invention in a third embodiment.

The gas-entering branch 3 of a typical gas combustion engine is not necessarily made of a conductive material, and may be formed of such members as rubber or plastic tubes. In that event, a grounding electrically conductive sheet 132 is disposed in accordance with the present invention on an inner tube wall 131 of the inlet branch 3 for cooperative operation with the output terminal 13 of the high-voltage loop of the power-increasing means 1 (as shown in detail in FIG. 3). Thus, even when the inlet branch 3 is not made of a readily conductive material, it may be made to operate with the output terminal 13 of the high-voltage loop of the power-increasing means 1 by equipping with the corresponding metal conductive sheet 132 in order to make the air cleaner.

Figure 4A:
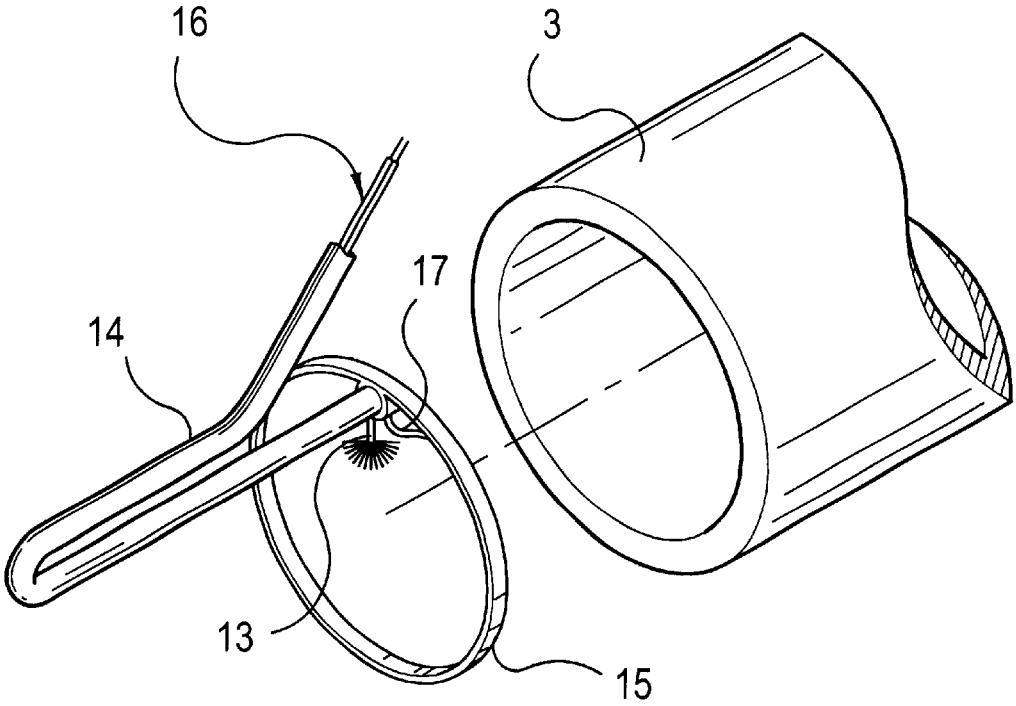
Figure 4B:
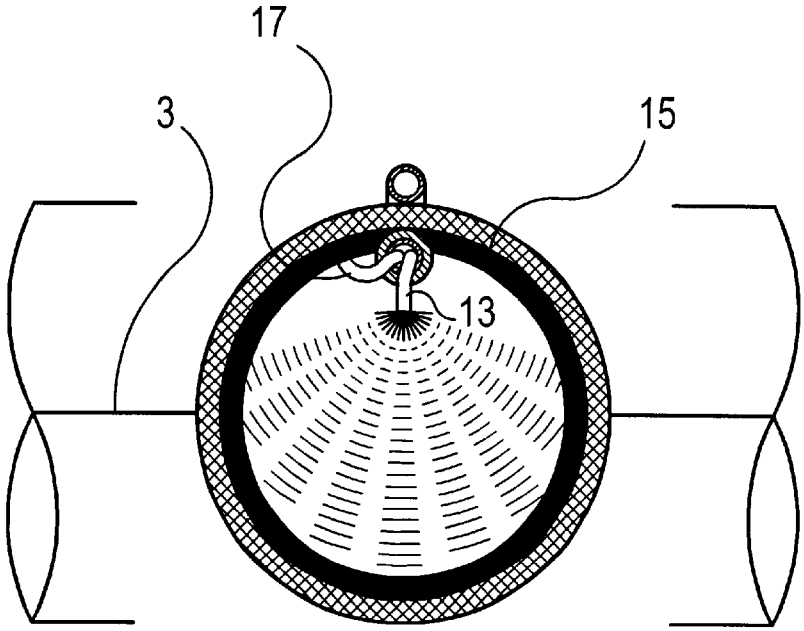

In practice, the user may need to drill a hole in the inlet branch 3 so that the output terminal 13 of the high-voltage loop of the power-increasing means 1 may be introduced therein to interact with the metal conducting sheet 3. In accordance with this invention, one could make use of a bendable hollow soft tube 14 as a conduit to guide the positive and negative pole electric wires into the inlet branch 3, as shown in FIGS. 4(A) and 4(B), obviating the need to drill any hole in the inlet branch 3. The positive and negative pole wires 16 are then guided by the hollow soft tube 14, and the negative pole output terminal 17 is fixed onto a metal ring 15 joined to the hollow soft tube 14. A positive pole output terminal 13 is fixed to hang from the inside of the metal ring 15, where it interacts with the negative pole output terminal 17. The pole output terminals 13, 17, and the metal ring 15 may then interact within the inlet branch 3.

The power enhancement control system for a combustion engine provided by this invention has the following advantages in comparison with the above-mentioned conventional technologies:

(1) Even if the inlet branch of a gas combustion engine is not made of electrically conductive materials, the effect of purifying the air may be achieved by way of the high-voltage loop terminal of the power increasing means cooperatively interacting with the metal electrically-conductive sheet disposed in accordance with the present invention.

(2) Even if the conventional power-increasing means fails, by means of the system in accordance with this invention the operator may still use the oxygen stored in the storage bottle by actuating the initiating switch and starting up the gate valve to achieve the result of the power-increasing means.

(3) This invention could be used upon retrofitting the existing power increasing mechanism to achieve a high-efficiency power-increasing mechanism.

(4) The practice of this invention may completely replace in operation the existing power-increasing means.

Many changes and modifications in the above-mentioned embodiment of this invention can, of course, be carried out without departing from the scope thereof. Accordingly, to promote the progress of science and the useful arts, the invention is disclosed and is intended to be limited only by the scope of the appended claims.

What is claimed is:

1. A power enhancement control system for a combustion engine comprising:

(a) a combustion chamber and an inlet branch extending therefrom, said inlet branch including a metallic conductive portion disposed therein;

(b) a power increasing portion including a high voltage loop device and a power input initiator coupled to a terminal thereof, said high voltage loop device having an output terminal extending into said inlet branch opposing said metallic conductive portion, said high voltage loop device being operable to generate at said output terminal thereof a high voltage responsive to actuation of said input initiator for augmenting the level of oxygen within said inlet branch; and, (c) a pressure-increasing auxiliary portion operably coupled to said power increasing portion, said pressure-increasing auxiliary portion including:

i. a directional control valve having a control terminal, said directional control valve being connected by pipeline to said inlet branch at a point thereon disposed between said output terminal of said high voltage loop device and said combustion chamber;

ii. a single-directional air flowing pump connected by pipeline to said directional control valve;

iii. a high-pressure gas storage bottle connected by pipeline to said single-directional air flowing pump, said high-pressure gas storage bottle having an outlet pipeline extending therefrom to said combustion chamber;

iv. a flow rate control valve coupled to said outlet pipeline;

v. an initiation switch coupled to said flow rate control valve for actuating a change in state of said flow rate control valve; and, vi. a pressure gauge coupled to said pipeline connecting said single-directional air flowing pump and said high-pressure gas storage bottle, and to said control terminal of said directional control valve.

2. The power enhancement control system as recited in claim 1 wherein switching of said directional control valve of said pressure-increasing auxiliary portion is actuated responsive to said pressure gauge, said pressure gauge including a panel display monitor for alerting a user.

3. The power enhancement control system as recited in claim 1 wherein said initiation switch is accessible for manual actuation by a user during system operation.

4. The power enhancement control system as recited in claim 1 wherein said flow rate control valve includes a gate valve device.

5. The power enhancement control system as recited in claim 1 wherein said metallic conductive portion includes an electrically grounded metallic sheet member lining a portion of an inner wall of said inlet branch.

6. The power enhancement control system as recited in claim 1 wherein said said metallic conductive portion includes a metal ring, and said high-voltage loop device further includes at least first and second pole terminal conductors of opposing polarity extending therefrom, said first and second pole terminal conductors being guided into said inlet branch through a hollow soft tube joined to said metal ring, said output terminal of said high-voltage loop device being connected to said first pole terminal conductor, said metal ring being connected to said second pole terminal conductor.

* * * * *